United States Patent [19]

Darnell

[11] 4,361,934

[45] Dec. 7, 1982

[54] GOLF SCORE CARD AND PENCIL HOLDER

[76] Inventor: Randolph G. Darnell, 32390 Hampton Ct., Union City, Calif. 94587

[21] Appl. No.: 176,927

[22] Filed: Aug. 11, 1980

[51] Int. Cl.[3] ..... A44B 21/00

[52] U.S. Cl. ..... 24/3 M; 24/11 PP; 24/302

[58] Field of Search ..... 24/298, 299, 300, 301, 24/302, 335, 336, 3 M, 11 R, 11 CC, 11 PP, 343, 370; 248/317, 328, 96; 224/274

[56] References Cited

U.S. PATENT DOCUMENTS

| | | | |
|---|---|---|---|
| 980,162 | 12/1910 | Meyer | 24/299 |
| 1,677,767 | 2/1928 | Goodridge | 24/299 |
| 1,688,506 | 10/1928 | Rivers | 24/3 M |
| 2,487,339 | 11/1949 | Kindlund et al. | 24/3 M |
| 4,159,792 | 7/1979 | Siegal | 24/3 M |

FOREIGN PATENT DOCUMENTS

| | | | |
|---|---|---|---|
| 856584 | 7/1949 | Fed. Rep. of Germany | 24/302 |
| 3254 | of 1895 | United Kingdom | 24/300 |

*Primary Examiner*—Robert A. Hafer

*Attorney, Agent, or Firm*—Paul L. Hickman

[57] ABSTRACT

A golf score card and pencil holder is disclosed including a main body portion in the form of a tag provided with a loop, an elongated cord laced through holes provided in the main body portion, a split ring linked with the loop, an alligator clip attached to one end of the cord, and a flexible grommet attached to the other end of the cord. In use, a pencil is press-fit through a hole of the grommet, a golf score card is clipped to the alligator clip, and the split ring is attached to a golf bag.

10 Claims, 4 Drawing Figures

FIG. 1
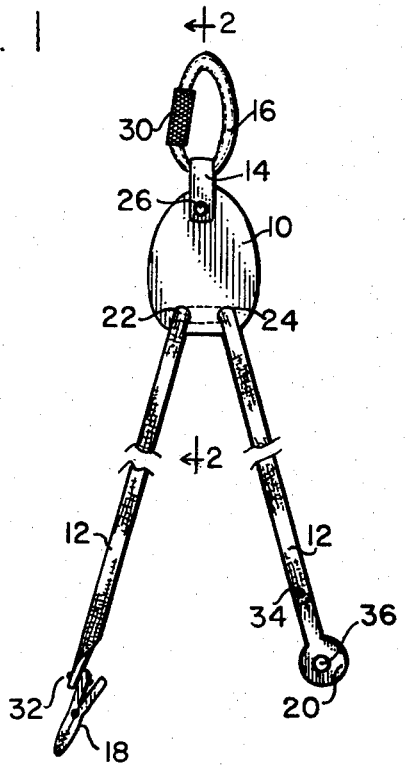
FIG. 2
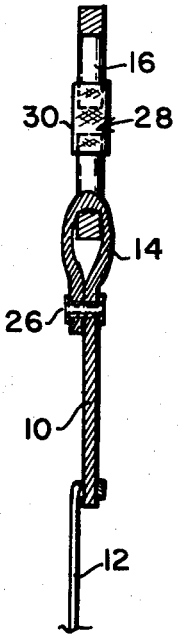
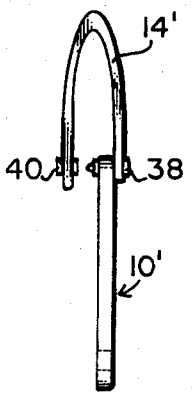
FIG. 3
FIG. 4
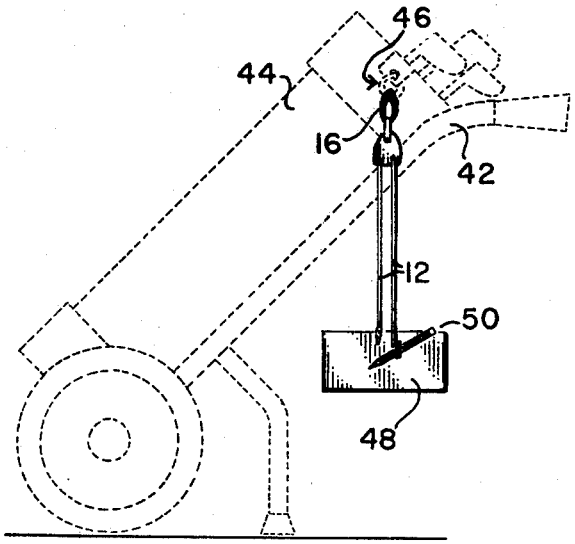

GOLF SCORE CARD AND PENCIL HOLDER

BACKGROUND OF THE INVENTION

1. Field of the Invention

This invention relates generally to sports equipment and more particularly to golfing accessories.

2. Description of the Prior Art

The task of carrying around a score card and a pencil has long been irksome to golfers. The card and pencil are not conveniently carried in a pocket because they could possibly interfere with a golf swing. If carried by hand they must be continually handed off to a golfing partner or put down and retrieved after each shot.

The above and other disconveniences have prompted a number of inventors to devise new ways of carrying golf score cards and pencils. A review of the prior art indicates that new devices fall within two major categories: (1) score card and pencil holders in the form of a clipboard, and (2) carriers and pouches.

An example of a device of the first category is described in U.S. Pat. No. 4,157,152 of D. Blastic. His device includes a stiff panel provided with a leaf spring clip at one end which holds a pencil, clips a score card to the panel, and holds the panel to a golf bag. In use, the pencil is removed from the device and the score is marked on the scorecard with the panel providing a firm writing surface.

Another example of a first category device is described in U.S. Pat. No. 2,523,590 of E. Potter et al. The device again includes a clipboard with a spring biased clip positioned at one end and further includes a pair of tube clamps for attaching the clip board to the handle of a golf cart. The use of Potter's device is substantially the same as Blastic's.

In U.S. Pat. No. 3,010,628 an example of the second category of device is described. In that patent W. Kowalczyk discloses a golfer's case including a multi-compartmented pouch removably attached to the lip of a golfing bag by a spring clip. A pencil and scoreboard, among other things, can be inserted into the compartments.

Other examples of devices which fall within the aforementioned categories include U.S. Pat. Nos. 3,128,021 of C. Habbena, 3,156,000 of E. Westhoff, 3,062,422 of L. Lord, 4,032,054 of N. Duncan and U.S. Pat. No. Des. 195,472 of M. Zimmers.

All of the above mentioned patents describe devices which carry and/or organize golf score cards, pencils and sometimes other accessories. The devices are rather complex assemblages which, unfortunately, make them relatively expensive to buy.

A disadvantage of the prior art devices is that they are somewhat cumbersome to use. For the clipboard type it is often necessary for the golfer to position himself relative the writing surface, which sometimes requires him to walk around the bag. For the carrier type it is necessary for the golfer to remove the pencil and the golf score card from their respective pouches and to individually return them to their pouches after use.

Finally, the prior art devices may prove, under some circumstances to be in the way. For example, all of the prior art devices attach either to the golf cart or to the mouth of the golf bag. In the former case it is possible that a golfer might inadvertently hit an edge of the device, causing personal injury and/or damage to the device. In the latter case it is contemplated that the removal and insertion of golf clubs to the bag may occasionally be interfered with.

SUMMARY OF THE INVENTION

It is an object of this invention to provide a simple, inexpensive and rugged golf score card and pencil holder that is further easy and efficient to use.

It is a further object of this invention to provide such a holder which does not interfere with the removal of golf clubs from a golf bag or their eventual reinsertion, and which will not injure a person who accidently bumps against it.

Briefly, the invention includes a flat tag which forms the main body portion of the holder, a long, elastic cord or ribbon laced through a pair of holes provided in the main body portion, an alligator clip attached to one end of the cord or ribbon, a rubber grommet attached to the other end of the cord or ribbon, a loop of material extending from the main body portion, and an openable ring linked with the loop of material for removably attaching the holder to a golf bag.

In an alternate embodiment of this invention the loop of material is removably attached to the main body portion by a snap and the ring is omitted. The loop itself then attaches the holder to the golf bag.

In use, a golf score card is held by the alligator clip and a pencil or pen is held by the rubber grommet. The score card is then supported in one hand and the pencil is grasped in the other and the score is marked. The elastic cord stretches to allow a person to stand where he pleases near the golf cart.

Advantages of this invention include its structural simplicity and low cost construction.

A further advantage of this invention is that it is so easy to use. A golfer does not have to be in any particular position relative the device to use it, nor does he have to remove the score card or pencil from the device at any time.

Yet another advantage of this invention is that the device hangs out of the way of the golf club and the golfer. Furthermore, the device is light enough so that should a golfer bump into it the possibility of injury would be very remote.

These and other objects and advantages of the present invention will no doubt become apparent upon a reading of the following descriptions and a study of the several figures of the drawing.

IN THE DRAWING

FIG. 1 is a front elevational view of a golf score card and pencil holder in accordance with the present invention.

FIG. 2 is a magnified cross sectional view taken along line 2—2 of FIG. 1.

FIG. 3 is a partial side elevational view of an alternate embodiment of the present device.

FIG. 4 illustrates the use of the present invention.

DETAILED DESCRIPTION OF THE PREFERRED EMBODIMENTS

Referring to FIGS. 1 and 2, a golf score card and pencil holder of the present invention includes a main body portion 10, an elongated, elastic cord or ribbon 12, a loop of material 14 upwardly extending from the main body portion, and an openable ring 16. Attached to one end of the ribbon 12 is an alligator clip 18 and attached to the other end is a rubber grommet 20.

Main body portion 10 is a thin, flat plate preferably made from leather or a thermoplastic material. In the embodiment of FIG. 1 the main body portion is substantially oval in shape although it could be of virtually any shape capable of supporting a ribbon 12 and a loop 14. Whatever its shape, however, its edges should be smooth to prevent accidental injury.

The main body portion is provided with a spaced apart pair of holes 22 and 24 through which the ribbon is laced. As best seen in FIG. 2, loop 14 is an extension of the material forming the main body portion and is bent back and attached to the main body portion by a rivet 26. The flat front and/or rear surfaces of the main body portion can be imprinted with insignia, advertisements or the golfer's name.

Ribbon 12 is shown to be a long, thin elastic band of the type used by tailors to provide elastic cuffs, waists, etc. Other types of cords or ribbons can also be used, such as round elastic cords, rubber cords or bands, and even non-elastic cords, ropes, strings or twines.

As mentioned previously, the ribbon 12 is laced through the holes of the main body portion. This allows the ribbon to be adjusted to make one leg of the ribbon longer and the other leg shorter. As will be explained later, this can help position the score card and the pencil for easy access and use.

Openable ring 16 is of the type including a split ring (as seen at 28 in FIG. 2) having its opening spanned by a sleeve 30. By unscrewing the sleeve the opening at 28 can be exposed to allow the holder to be attached to a golf bag.

Alligator clip 18 is preferably attached to ribbon 12 by a small rivet 32. In FIG. 1, the clip is shown twisted slightly out of plane to better illustrate its construction.

Grommet 20 is also attached to ribbon 12 by a small rivet 34. The grommet is a small, flat, flexible member having a rounded end portion provided with a small hole 36 and an elongated portion extending from the round portion for attachment to the ribbon.

In FIG. 3, a part of an alternate embodiment of the holder of the present invention is shown. In this embodiment the ring 16 is omitted and an elongated loop 14' (corresponding to loop 14 of FIG. 1) is removably fastened to main body portion 10' (corresponding to main body portion 10 of FIG. 1). As seen, loop 14' is made from a piece of material that is separate from the main body portion and which is attached to that portion by a male snap fastener 38. A female snap fastener 40 is attached to the free end of the loop for removably engaging the male snap. The entire loop is thus openable and closable and can attach the holder to a golf bag.

The use and operation of the present device will be explained with reference to FIG. 4. As shown in broken lines, a golf bag carrier 42 holds a golf club bag 44. Ring 16 attaches to a ring 46 of the golf bag. A score card 48 is attached to the holder by the alligator clip and a pencil 50 is press-fit the the hole of the grommet.

In use, a golfer grasps ribbon 12 and pulls the score card and the pencil to hand. The score is then entered and the score card and pencil dropped to return them to their original position.

It may be that the golfer will want to have one leg of the ribbon longer than the other leg. For example, by pulling the ribbon through holes 22 and 24 the left leg of the ribbon can be shortened and the right leg lengthened to give more freedom of movement to the pencil.

Since the ribbon can stretch the golfer can keep score from a number of positions around his golf bag. Preferably the holes 22 and 24 provide a tight enough grip on the ribbon so that the ribbon will not accidently slide through the holes which stretched slightly by the score keeper.

While this invention has been described in terms of a couple of preferred embodiments, it is contemplated that various modifications and permutations thereof will become apparent to those reading the preceding descriptions and studying the drawing. It is therefore intended that the following appended claims be interpreted as including all such modifications and permutations as fall within the true spirit and scope of the present invention.

What is claimed is:

1. A golf score card and pencil holder comprising a main body portion including a plate section; a thin, elongated extension section; and fastener means attaching the distal end of said elongated extension section to said plate to form said extension into a loop, means engaged with said loop for removably attaching said main body portion to a golf bag, first cord means extending from said plate section, clip means attached to an end of said first cord means, second cord means extending from said plate section, and writing instrument holder means attached to an end of said second cord means.

2. A holder as claimed in claim 1 wherein said plate section is provided with a pair of spaced apart apertures and wherein said first cord means and said second cord means include a continuous length of cord laced through said apertures.

3. A holder as claimed in claim 2 wherein said continuous length of cord is longitudinally elastic.

4. A holder as claimed in claim 3 wherein said plate section is a smooth edged plate of material.

5. A holder as claimed in claim 4 wherein said clip means includes an alligator clip.

6. A holder as claimed in claim 5 wherein said holder means includes a flexible grommet of an expansile material dimensioned to receive a writing instrument in a press-fit.

7. A holder as claimed in claim 6 wherein said alligator clip and said grommet are riveted to respective ends of said cord means.

8. A holder as claimed in claim 1 further comprising an openable ring linked with said loop.

9. A holder as claimed in claim 1 wherein said fastener means includes a snap-type fastener removably attaching said distal end to said plate of material.

10. A golf score card and pencil holder comprising a main body portion including a smooth edged plate section, an elongated extension section, and fastener means attaching a distal end of said elongated extension section to said plate to form said extension into a loop, said plate section being provided with a plurality of apertures;

a continuous length of longitudinally elastic cord laced through said apertures;

an alligator clip riveted to one end of said length of cord; and a flexible grommet riveted to the other end of said length of cord, where said grommet is dimensioned to receive a writing instrument in a press fit.

* * * * *